US005230960A

United States Patent [19]

Iizuka

[11] Patent Number: 5,230,960

[45] Date of Patent: Jul. 27, 1993

[54] ACTIVATED CARBON FIBER STRUCTURE AND PROCESS FOR PRODUCING THE SAME

[75] Inventor: Toshi Iizuka, Takasaki, Japan

[73] Assignee: Gun Ei Chemical Industry Co., Ltd., Gunma, Japan

[21] Appl. No.: 653,544

[22] Filed: Jan. 7, 1991

[30] Foreign Application Priority Data

Jan. 12, 1990 [JP] Japan ..... 2-3327

[51] Int. Cl.[5] ..... B32B 9/00; B32B 17/00; D02G 3/00

[52] U.S. Cl. ..... 428/408; 428/367; 428/902; 423/447.2

[58] Field of Search ..... 428/367, 408, 902

[56] References Cited

U.S. PATENT DOCUMENTS

| | | | |
|---|---|---|---|
| 3,301,742 | 1/1967 | Noland et al. | 428/367 |
| 3,552,922 | 1/1971 | Ishikawa et al. | 23/209.1 |
| 3,639,953 | 2/1972 | Kimura et al. | 23/29.1 |
| 3,903,220 | 9/1975 | Economy et al. | 264/29 |
| 4,014,725 | 3/1977 | Schulz | 428/367 |
| 4,929,505 | 5/1990 | Washburn et al. | 428/408 |

FOREIGN PATENT DOCUMENTS

| | | |
|---|---|---|
| 0149333 | 7/1985 | European Pat. Off. . |
| 53-52734 | 5/1978 | Japan . |
| 55-7538 | 1/1980 | Japan . |
| 60-167929 | 8/1985 | Japan . |
| 61-132629 | 6/1986 | Japan . |
| 62-152534 | 7/1987 | Japan . |
| 62-289618 | 12/1987 | Japan . |

OTHER PUBLICATIONS

Hercules Product Data Sheet No. 852.

Booth et al., Calculation of Fiber Volume Fraction & Matrix Density of 2-D Carbon/Carbon Composites.

*Primary Examiner*—George F. Lesmes
*Assistant Examiner*—Kathryne E. Shelborne
*Attorney, Agent, or Firm*—Armstrong, Westerman, Hattori, McLeland & Naughton

[57] ABSTRACT

An activated and heat-treated product of a pitch fiber (A) is combined with an activated and heat-treated product of a precursor fiber of carbon fiber (B) having a larger elongation and a larger shrinkage during activation treatment thereof than those of the pitch fiber (A) to provide an activated carbon fiber structure. The activated carbon fiber structure is produced by subjecting the pitch fiber (A) and the precursor fiber of carbon fiber (B) to an activation treatment before or after the fibers (A) and (B) are formed into a configuration corresponding to a fiber structure through mixing or laminating.

7 Claims, No Drawings

ACTIVATED CARBON FIBER STRUCTURE AND PROCESS FOR PRODUCING THE SAME

BACKGROUND OF THE INVENTION

1. Field of the Invention

The present invention relates to an activated carbon fiber structure excellent in processability, durability, adsorptive and desorptive characteristics, etc., and to a process for producing the same. More particularly, the present invention relates to an activated carbon fiber structure well adapted for use as an adsorbent, a deodorizer, a filter, etc., and to a process for producing the same.

2. Prior Art

Activated carbon fibers are produced by treating a variety of respective carbon fibers or precursor fibers of carbon fibers with steam, carbon dioxide or the like to activate the same. However, no carbon fibers which are satisfactory in overall performance, including processability, durability, etc., have so far been materialized.

For example, activated carbon fibers of phenolic resin type have a large specific surface area and can be relatively arbitrarily controlled in pore size. Therefore, they are characterized by a wide range of adsorbate substances ranging from low molecular weight ones to high molecular weight ones as well as a large amount of adsorption. However, phenolic resin fibers as the precursor fibers of these activated carbon fibers have a defect of poor processability during the course of forming the same into a fiber structure because of their low tensile strengths, despite their large elongations.

In order to obviate this defect, the activated carbon fibers or the precursor fibers thereof are reinforced with a high-strength fiber. However, this quite often entails deteriorated overall adsorption efficiency and reduced heat resistance of the reinforced structure.

Furthermore, since phenolic resin fibers are large in shrinkage during the course of heat treatment thereof for activation (hereinafter referred to as "activation treatment"), there arises a problem that a large morphological change occurs between before and after activation treatment.

On the other hand, activated carbon fibers of pitch type are substantially comparable in adsorptive performance to the activated carbon fibers of phenolic resin type, and have been high in tensile strength and modulus of elasticity before activation thereof. Nevertheless, the activated carbon fibers of pitch type tend to be brittle because of their small elongations. This presents a problem of poor handleability of fiber during the course of shaping the fiber into a structure.

Unlike common organic fibers, carbon fibers of pitch type are relatively free from twisting, bending and crimping, and substantially circular in cross section, with the result that they have a characteristic liability to undergo interfiber adhesion. This favorably increases the utilization of fiber strength in the case where the carbon fibers are used as reinforcing fibers, but presents a problem that, when the carbon fibers are used as adsorbents, fluid migration is hindered to keep an adsorbate component from diffusing through interfiber spaces because the fibers are liable to undergo interfiber adhesion. Furthermore, the carbon fibers of pitch type involve the difficulty in effective needling because of their liability to interfiber exfoliation, thereby presenting a problem that a difficulty is encountered in manufacturing therefrom mats and the like with high bulk density.

An object of the present invention is to provide an activated carbon fiber excellent in overall performance, including processability, adsorptive and desorptive characteristics, etc., and a structure constituted thereof.

Another object of the present invention is to provide a solution to the problems ensuing from the low strengths and large shrinkages of the conventional organic fibers such as phenolic resin fibers.

A further object of the present invention is to provide such an improvement as to overcome the small elongations and poor processabilities as well as problematically excessive interfiber adhesion or exfoliation of the conventional activated carbon fibers of pitch type.

SUMMARY OF THE INVENTION

In accordance with one aspect of the present invention, there is provided an activated carbon fiber structure comprising an activated and heat-treated product of a pitch fiber (A), and an activated and heat-treated product of a precursor fiber of carbon fiber (B) having a larger elongation and a larger shrinkage during activation treatment thereof than those of the pitch fiber (A).

In accordance with another aspect of the present invention, there is provided a process for producing an activated carbon fiber structure, comprising the step of subjecting a pitch fiber (A) and a precursor fiber of carbon fiber (B) having a larger elongation and a larger shrinkage during activation treatment thereof than those of the pitch fiber (A) to an activation treatment before or after the pitch fiber (A) and the precursor fiber of carbon fiber (B) are formed into a configuration corresponding to a fiber structure through mixing or laminating.

The present invention will now be described more specifically.

The term fiber structure as used in the present invention is such a generic term as to include cotton-like matter, filaments, spun yarns, slivers, non-woven fabrics, woven fabrics, knitted fabrics, combinations thereof, and other structures of fibers with an arbitrary shape formed through simple mixing, laminating or the like.

The formation of the pitch fiber (A) and the precursor fiber of carbon fiber (B) into the configuration corresponding to the fiber structure through mixing, laminating or the like is done specifically by a customary method such as blending, carding or laminating of mat-like forms thereof.

The combination of the pitch fiber (A) having a high strength with the precursor fiber of the carbon fiber (B) having a large elongation greatly improves the processability of fibers during the course of forming the same into the configuration corresponding to the fiber structure.

Pitch fibers of petroleum, coal or like type as commonly used as starting materials of activated carbon fibers can be used as the pitch fiber (A) to be used in the present invention. Preferred are pitch fibers formed by spinning isotropic pitch having a high softening point of, for example, at least 120° C. according to a common melt-spinning, melt-blow or like method.

The pitch fiber (A') formed from isotropic pitch, which is easy of activation, can be converted into an activated carbon fiber excellent in adsorptive characteristics. Since the pitch fiber before treated to be rendered infusible is so extremely weak as to be often incapable of resisting the processing thereof to form the same into the configuration corresponding to the fiber structure, it is preferable that the pitch fiber after treated to be rendered infusible or to be slightly carbonized should be used as the pitch fiber (A).

Alternatively, the pitch fiber (A) carbonized at a temperature higher than the activation treatment temperature may be used, but the use of it is economically disadvantageous.

The precursor fiber of carbon fiber (B) to be used in the present invention, which is an organic fiber not required to be rendered infusible, is preferably at least 5% larger in elongation than the pitch fiber (A), and is preferably 7 to 30% larger in shrinkage during the course of the activation treatment thereof than the pitch fiber (A).

When the precursor fiber (B) is inside of 5% larger in elongation than the pitch fiber (A), the effect of improving the processability of the pitch fiber (A) during the formation into the configuration corresponding to the fiber structure may be so poor that damage to the fiber structure may be unfavorably increased.

As will be apparent from the foregoing description, one feature of the present invention lies in the use of the precursor fiber of carbon fiber (B) having a larger shrinkage during the course of the activation treatment thereof than the pitch fiber (A).

When the pitch fiber (A) and the precursor fiber (B) are subjected in the form of a fiber structure to the activation treatment, a specific difference of 7 to 30% in shrinkage therebetween gives rise to a dimensional difference in terms of length between the two types of fibers in the fiber structure, which in turn gives rise to bending of the pitch fiber (A) (reduced shrinkage and hence retaining more length) in the areas of bundles of juxtaposed fiber filaments to hardly cause interfiber adhesion of the pitch fiber (A) while mitigating the shrinkage of the precursor fiber (B). This makes the fiber structure bulky as a whole. This facilitates the migration by diffusion of an adsorbate through the inside of the resulting activated carbon fiber structure to improve the adsorptive effect thereof.

Furthermore, making the fiber structure bulky in this way improves the compression resistance, impact resistance and fatigue resistance thereof. When the shrinkage of a fiber used to bundle, entangle or sew the fibers (A) and (B) together to form the configuration corresponding to the fiber structure is large, the fiber structure is compressed in keeping with the shrinkage of the bundling, entangling or sewing fiber to raise the density of the structure, with the result that the fiber-holding power of the structure is increased to improve the abrasion resistance and vibration resistance of the fiber structure.

When the difference of the shrinkage of the precursor fiber of carbon fiber (B) from that of the pitch fiber (A) is smaller than 7%, the effects of imparting bulkiness and the like to the fiber structure, which are aimed at in the present invention, may not be fully exhibited, with the result that the performance of the fiber structure may unfavorably be not far from those of conventional activated carbon fiber structures.

When it is larger than 30%, the strain applied to the precursor fiber (B) having the larger shrinkage and the stress applied to the pitch fiber (A) inside the activated carbon fiber structure may grow too strong, with the result that the durability of the activated carbon fiber structure may adversely be lowered. The difference of the shrinkage of the fiber (B) from that of the fiber (A) during activation treatment is more preferably 15 to 25%.

The activation treatment of the pitch fiber (A) and the precursor fiber of carbon fiber (B) may essentially be effected by any known method. In general, it is effected through heating using a reactive gas such as steam or carbon dioxide in an inert atmosphere such as nitrogen at a temperature of about 700° to 1,200° C. for a period of about 0.5 to 4 hours. This treatment easily enables the fibers constituting the fiber structure to be rendered so porous and active as to be capable of adsorbing a fluid.

The activation treatment is made preferably after the fibers are treated to be rendered infusible or to be slightly carbonized. The activation treatment may be made either before or after the fibers (A) and (B) are formed into the configuration corresponding to the fiber structure. It is however preferable from the viewpoint of handling that the treatment be performed after the formation into the configuration corresponding to the fiber structure.

Heat-resistant precursor fibers of carbon fiber capable of being activated without infusibilization are preferable as the precursor fiber of carbon fiber (B) to be used in the present invention. In this respect, phenolic resin fibers are especially preferred.

The proportion of the pitch fiber (A) to the precursor fiber of carbon fiber (B) in combination can be arbitrarily set without any particular limitations in accordance with characteristics such as bulkiness, which are required of the activated carbon fiber structure to be produced according to the present invention. In order to take full advantage of the merits of both the pitch fiber (A) and the precursor fiber (B), however, the proportion of the pitch fiber (A) to the precursor fiber (B) in combination is preferably about 30 to 70 wt. %.

The activated carbon fiber structure of the present invention is capable of taking various forms such as yarns, woven fabrics, knitted fabrics, non-woven fabrics and composite structures thereof.

The activated carbon fiber structure of the present invention is relatively bulky and excellent in cushioning properties, and hence is characterized by being strongly resistant to impact, abrasion and flexure.

The activated carbon fiber structure of the present invention is also characterized by having uniform interfiber spaces and allowing for easy diffusion of adsorbate substances and desorbate substances (substances capable of being desorbed) through the inside thereof.

The activated carbon fiber structure of the present invention, which holds the shape of fibers, can be used as a general purpose adsorbent, deodorizer, filter, etc. The activated carbon fiber structure of the present invention is also excellent as an adsorbent for use in removal of foul odors and the like in rooms and inside cars because it exhibits an excellent performance even in almost stationary fluid surroundings.

Advantageous functions of the present invention will be summarized as follows.

According to the present invention, processability is greatly improved by mixing or laminating together the pitch fiber (A) having a high strength and the precursor fiber of carbon fiber (B) having a large elongation into the configuration corresponding to the fiber structure.

When the pitch fiber (A) and the precursor fiber of carbon fiber (B) are subjected in the form of a fiber structure to the activation treatment, a specific difference in shrinkage therebetween gives rise to a dimensional difference in terms of length between the two types of fibers in the fiber structure, which in turn gives rise to bending of the pitch fiber (A) (reduced shrinkage and hence retaining more length) in the areas of bundles of juxtaposed fiber filaments to hardly cause interfiber adhesion of the pitch fiber (A) while mitigating the shrinkage of the precursor fiber (B), with the result that the fiber structure is rendered bulky as a whole. This bulkiness of the fiber structure facilitates the migration by diffusion of an adsorbate through the inside of the resulting activated carbon fiber structure to improve the adsorptive effect thereof.

The bulkiness of the fiber structure improves the compression resistance, impact resistance and fatigue resistance thereof. When the shrinkage of a fiber used to bundle, entangle or sew the fibers (A) and (B) together to form a configuration corresponding to the fiber structure is large, the fiber structure is compressed in keeping with the shrinkage of the bundling, entangling or sewing fibers to raise the density of the structure, with the result that the fiber-holding power of the structure is increased to improve the abrasion resistance and vibration resistance of the structure.

BEST MODES FOR CARRYING OUT THE INVENTION

The following Examples will now specifically illustrate the present invention in more detail, but should not be construed as limiting the scope of the invention.

EXAMPLE 1

Isotropic coal pitch having a softening point of 245° C. as a raw material was spun, rendered infusible and carbonized slightly (maximum temperature: 630° C.) to prepare a pitch fiber (A). The carbon fiber [pitch fiber (A)] having a diameter of 14 μm, a cut staple fiber length of about 50 mm, a tensile strength of 60 kg/mm$^2$ and an elongation of 2.9% was mixed with the same amount by weight of a 2-denier phenolic resin fiber having a staple fiber length of about 50 mm, a tensile strength of 20 kg/mm$^2$ and an elongation of 35% (Kynol manufactured by Gun-ei Chemical Industry Co., Ltd.) as a precursor fiber of carbon fiber (B) to spin yarns.

The resulting spun yarns (cotton count: 6) were woven into a plain fabric having a density of 12 woof strands/25 mm×12 warp strands/25 mm. This fabric was treated in a nitrogen stream containing 35 vol. % of steam at 850° C. for 1 hour to be activated.

The resulting activated carbon fiber fabric had a specific surface area of 1, 645 m$^2$/g and showed a decoloring capacity of 227 ml/g in terms of the maximum amount of Methylene Blue decolored per g of fiber when examined by a Methylene Blue decoloring test in accordance with JIS K-1470.

In a toluene vapor adsorption test carried out in a vessel at rest, the above-mentioned activated carbon fiber fabric showed a higher adsorption rate than respective activated carbon fiber fabrics produced from a fabric of a pitch fiber alone and a fabric of a phenolic resin fiber alone and having substantially the same specific surface area and Methylene Blue decoloring capacity, and showed a smaller morphological change than the activated carbon fiber fabric produced from the fabric of the phenolic resin fiber alone.

Additionally stated, when the pitch fiber (A) and the precursor fiber (B) were carbonized in an inert gas by heating up to 900° C. at a heat-up rate of 5° C./min. the shrinkage of the pitch fiber (A) was 3% while the shrinkage of the phenolic resin fiber (B) was 24%.

EXAMPLE 2

Isotropic petroleum pitch having a softening point of 228° C. as a raw material was spun by a melt blow method, and rendered infusible and slightly carbonized by a customary method (maximum temperature: 780 ° C) to prepare a pitch fiber having a tensile strength of 84 kg/mm$^2$ and an elongation of 2.1%, which was then formed into a matted material having a unit weight of 120 kg/m$_2$. This matted material of the pitch fiber and a matted material of phenolic resin fiber having a unit weight of 200 g/m$^2$ (phenolic resin fiber: Kynol manufactured by Gun-ei Chemical Industry Co., Ltd.) was subjected to carding to produce card webs having a proportion of pitch fiber/phenolic resin fiber in combination of 70 wt. %/30 wt. %. A few card webs produced in the foregoing manner were laminated on each other and subjected to needle punching at a punching density of 25 times/cm.$^2$ The resulting fiber structure in the form of a non-woven fabric was treated in a nitrogen stream containing 40 vol. % of steam at 830 ° C for 75 minutes to be activated.

The resulting activated carbon fiber structure had an adsorptive performance at least comparable to that of an activated carbon fiber non-woven fabric produced from the phenolic resin fiber alone, and was so better in entanglement effect than an activated carbon fiber non-woven fabric produced from the petroleum pitch fiber alone that the amount of fibers falling off by friction was decreased and the decrease in thickness of the fabric through repeated vibrations and impacts was minimized. Furthermore, the pulverization of the fabric during the course of practical use thereof was reduced.

Additionally stated, when the fibers were carbonized in an inert gas by heating the same up to 950° C. at a heat-up rate of 3.5 ° C/min, the shrinkage of the pitch fiber was 5% while the shrinkage of the phenolic resin fiber was 25%.

What is claimed is:

1. A porous activated carbon fibre structure, wherein the fiber structure is selected from the group consisting of filaments, spun yarns, slivers, non-woven fabrics, knitted fabrics, and felt capable of adsorbing liquids, comprising:

30 to 70% of a first carbon fiber (A) obtained by heat-treating and activating a spun pitch;

a second carbon fiber obtained by heat-treating and activating an organic precursor fiber (B);

said precursor fiber (B) being at least 5% greater in elongation, and 7 to 30% greater in shrinkage during heat-treatment and activation, said first fiber and said second fiber having substantially the same degree of activation.

2. A porous activated carbon fiber structure according to claim 1 wherein said precursor fiber (B) is a phenolic resin fiber.

3. A porous activated carbon fiber structure according to claim 1 wherein said pitch is isotropic pitch.

4. A porous, activated carbon fiber structure made by the process of commingling a fiber spun from pitch with a phenolic fiber, and carbonizing and activating the commingled fibers.

5. A carbon fiber structure according to claim 4 wherein commingling is performed using a process selected from the group consisting of spinning, weaving, knitting, entangling and melt adhesion.

6. A carbon fiber structure according to claim 4 wherein the pitch fiber is carbonized to a temperature of 630° C. prior to commingling.

7. A carbon fiber structure according to claim 4 wherein the carbonized pitch fiber and carbonized phenolic fiber are activated to substantially the same degree.

* * * * *